US005912033A

United States Patent [19]

Ferguson

[11] Patent Number: 5,912,033

[45] Date of Patent: Jun. 15, 1999

[54] BAKED GOODS CONTAINER

[76] Inventor: Kathy Ferguson, 3167 Nickelby, Shelby Township, Mich. 48316

[21] Appl. No.: 09/041,532

[22] Filed: Mar. 12, 1998

[51] Int. Cl.[6] ..... A21D 10/02; B65D 1/24

[52] U.S. Cl. ..... 426/124; 426/119; 426/128; 220/507; 220/529

[58] Field of Search ..... 426/110, 119, 426/124, 128, 108; 206/652; 220/507, 529; 211/14; 248/580

[56] References Cited

U.S. PATENT DOCUMENTS

| | | | |
|---|---|---|---|
| D. 257,116 | 9/1980 | Lakatos et al. | D7/96 |
| D. 348,378 | 7/1994 | Crane | D7/610 |
| D. 400,055 | 10/1998 | Mc Fadzean | D7/610 |
| 4,583,955 | 4/1986 | Toloczko | 446/73 |
| 5,012,655 | 5/1991 | Chatterton | 62/340 |
| 5,048,506 | 9/1991 | Hayashi | 126/262 |
| 5,244,095 | 9/1993 | DeVoe | 206/575 |
| 5,450,785 | 9/1995 | Westbrooks | 99/426 |

*Primary Examiner*—David Lacey
*Assistant Examiner*—Drew Beeker
*Attorney, Agent, or Firm*—Harness, Dickey & Pierce, P.L.C.

[57] ABSTRACT

A food storage and transportation device primarily including a container, a plurality of removable inserts, and a lid is described. The inner surface of the container has a plurality of groove and shelf assemblies. The removable inserts have a plurality of tabs extending radially outward, a set of handles, and a plurality of openings for receiving a plurality of cupcakes. In operation, the cupcakes are placed into the respective openings with the base of the cupcakes extending through the opening, whereas the top of the cupcake is retained above a top surface of the removable insert. The removable inserts and cupcakes are then loaded into the container. At no time does any cupcake come into contact with any other cupcakes. To remove the cupcakes, the removable insert is removed from the container and placed on a flat surface, whereupon the cupcakes are conveniently dislodged from their respective openings.

22 Claims, 3 Drawing Sheets

BAKED GOODS CONTAINER

BACKGROUND OF THE INVENTION

1. Technical Field

The present invention relates generally to food storage and transportation, and particularly to a device for storing and transporting baked goods such as, but not limited to, cupcakes, muffins, and the like.

2. Discussion

The storage and transportation of foodstuffs has presented numerous problems to manufacturers who have attempted to develop devices to safely, securely, and economically store and transport foodstuffs, including baked goods. With respect to baked goods, there is special interest in the storage and transportation of cupcakes, muffins, and the like.

Cupcakes are generally defined as a small cake baked in a cuplike mold. Cupcakes may optionally have various fillings injected into their cores and may have various frostings or icings applied to one or more of their outer surfaces, particularly the top surface.

Cupcakes are generally circular in shape and typically have an enlarged upper portion (referred to as the top for reference purposes) and a relatively smaller lower portion (referred to as the base for reference purposes). The shape of the cupcake is largely a function of the shape of the mold in which the cupcake batter is baked. Because the cupcake batter can only rise upwardly and outwardly away from the mold, a top is usually formed on the cupcake. Additionally, because the typical cupcake mold has a truncated conical shape, the base of the cupcake invariably has a diameter less than that of the top of the cupcake. As a result of this geometric configuration, cupcakes are, to a certain extent, inherently unstable. This instability is present even when the cupcake is placed on a substantially level surface. Even a relatively slight application of force is usually sufficient to tip most cupcakes over onto their sides. Thus, the conventional storage and transportation of cupcakes has been rendered extremely difficult due to their inherent instability.

This instability presents a special problem when attempting to transport frosted cupcakes having different flavor frostings from one location (e.g., a kitchen) to a remote location (e.g., a picnic, party, or the like). Typically, the frosted cupcakes are placed in a single layer on a dish, plate, or the like. Because cupcakes have a tendency to tip over and fall rather easily, especially during transport, cupcakes having frosting of one flavor invariably come into contact with adjacent frosted cupcakes, thus intermingling the various flavors of frostings. Additionally, problems arise when attempting to transport highly decorated cupcakes. If these highly decorated cupcakes were to tip over, their aesthetic appearance would be suffer considerably. Culinary concerns aside, these problems can present a potentially serious health hazard if a person who is allergic to chocolate inadvertently consumes a cupcake that has contacted a portion of chocolate frosting from an adjacent cupcake. Additionally, a similar health hazard could occur if a diabetic person inadvertently consumes an ostensibly sugar-free frosted cupcake that has contacted a portion of sugar-containing frosting from an adjacent cupcake.

Coverings such as aluminum foil, wax paper, plastic wrap, or the like have been used in an effort to overcome this instability. However, the use of a covering may only serve to lessen the instability and not eliminate it completely. Additionally, the use of coverings has the unwanted effect of mashing the frosting down onto the side surfaces of the cupcake, making it difficult for consumers to handle the cupcake without getting frosting onto their hands. Finally, the frosting has a tendency to adhere to some types of coverings as opposed to remaining on the top surface of the cupcake, thus wasting significant amounts of frosting when the covering is removed from the cupcakes.

Additionally, some cupcakes have relatively delicate crumb toppings. A covering could have the unwanted effect of rubbing against and eventually causing the crumb topping to fall off of the cake portion of cupcake.

Another problem with the use of plates or other conventional items to store and transport cupcakes is that cupcakes tend to heavily soil any surfaces they come into contact with. This is believed to be caused by the leaching out of fatty substances (e.g., butter, oils, and the like) used in the preparation of the cupcakes. Thus, any plates, dishes, and the like need to be thoroughly cleaned of these fatty substances.

Yet another problem with the use of plates and the like to store and transport cupcakes is that usually only a single layer of cupcakes may be placed upon the plate surface, especially if the cupcakes are frosted. Two layers of unfrosted cupcakes placed upon a plate would present a highly unstable situation, as the top layer of cupcakes would have a greatly increased tendency to tip or fall due to the fact that they are disposed on a highly irregular surface (i.e., the tops of the bottom layer of cupcakes). Additionally, two layers of frosted cupcakes placed upon a plate would be highly impractical in that the frosting of the bottom layer cupcakes would adhere to the bottom of the top layer of cupcakes. Thus, a number of plates are typically needed to store and transport even relatively small amounts of cupcakes.

Therefore, there exists a need for a device for storing and transporting baked goods such as, but not limited to, cupcakes, muffins, and the like, wherein the device allows for the segregation and stabilization of the cupcakes.

It is accordingly an object of the present invention to provide a new and improved food storage and transportation device.

It is another object of the present invention to provide a new and improved food storage and transportation device that is sealable.

It is another object of the present invention to provide a new and improved food storage and transportation device having at least one removable insert, the removable insert having at least one opening for receiving and supporting at least one cupcake.

It is another object of the present invention to provide a new and improved food storage and transportation device having a plurality of removable inserts, the removable inserts having a plurality of openings for receiving and supporting a plurality of cupcakes.

It is another object of the present invention to provide a new and improved food storage and transportation device having a plurality of removable inserts, the removable inserts having a plurality of openings for receiving and supporting a plurality of cupcakes, the base of the cupcake extending through the opening and the top of the cupcake being retained above the top surface of the removable insert so as to provide stability to the cupcake during transportation.

It is another object of the present invention to provide a new and improved food storage and transportation device having a plurality of removable inserts, the removable inserts having a plurality of openings for receiving and supporting a plurality of cupcakes, wherein the openings are spaced a sufficient distance away from the adjacent opening so as to prevent adjacent cupcakes from contacting one another.

It is another object of the present invention to provide a new and improved food storage and transportation device having a plurality of removable inserts, the removable inserts having a plurality of openings for receiving and supporting a plurality of cupcakes, wherein the cupcakes are segregated from adjacent cupcakes on the same removable insert and from cupcakes on other removable inserts.

In order to overcome the aforementioned disadvantages and achieve the aforementioned objects, the present invention provides a food storage and transportation device for storing and transporting baked goods such as, but not limited to, cupcakes, muffins, and the like, in accordance with the following embodiments.

SUMMARY OF THE INVENTION

In accordance with one embodiment of the present invention, a food storage and transportation device comprises:

a container;

at least one support member, the support member being disposed on and projecting from an inner surface of the container; and at least one removable insert, the removable insert having a plurality of openings and being disposed on the support member.

In accordance with another embodiment of the present invention, a food storage and transportation device comprises:

a container;

at least one support means, the support means being disposed on and projecting from an inner surface of the container; and at least one removable insert, the removable insert having a plurality of horizontally oriented tabs extending radially outward, the removable insert having a plurality of openings and being disposed on the support means.

In accordance with yet another embodiment of the present invention, a food storage and transportation device comprises:

a container, the container having an inner surface and an outer surface;

at least one support means, the support means being disposed on and projecting from an inner surface of the container, the support means comprising a plurality of support members defining a groove and a shelf member;

at least one removable insert, the removable insert having a plurality of openings, the removable insert having a plurality of horizontally oriented tabs extending radially outward, the tab being received in the support member and disposed on the shelf member of the support member; and a lid.

A more complete appreciation of the present invention and its scope can be obtained from understanding the accompanying drawings, which are briefly summarized below, the following detailed description of the invention, and the appended claims.

BRIEF DESCRIPTION OF THE DRAWINGS

The same reference numerals refer to the same parts throughout the various Figures.

DETAILED DESCRIPTION OF THE INVENTION

Figure 1:
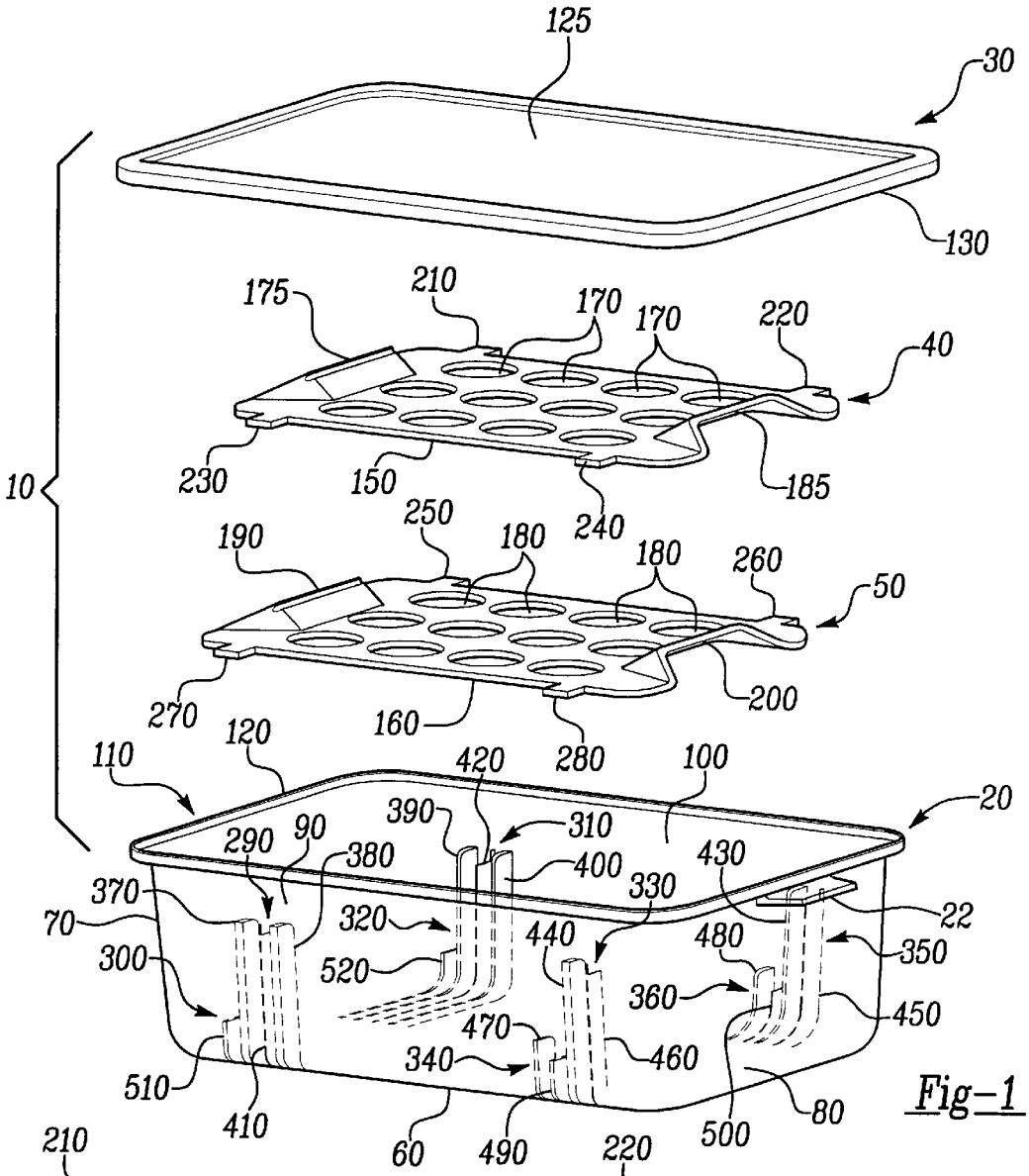
FIG. 1 is an exploded view of a device in accordance with one embodiment of the present invention.

Although primarily directed to the storage and transportation of cupcakes, the present invention can be practiced with a variety of baked goods, such as, but not limited to, muffins, and the like. Additionally, other goods besides baked goods could be stored and transported with the present invention provided that they are able to be received, supported, and retained in the openings of the removable inserts.

Referring to FIGS. 1–5, there is generally shown a device 10 for storing and transporting baked goods, such as, but not limited to, cupcakes, muffins, and the like, in accordance with one embodiment of the present invention. It should be noted that the term "cupcake" is being used synonymously for the term "baked good" throughout the instant patent application. The device 10 primarily consists of a container 20, a lid 30, and a plurality of removable inserts 40 and 50. Although two removable inserts are shown, it will be appreciated by the skilled artisan that the present invention may be practiced with only one removable insert or, alternatively, more than two removable inserts.

The device 10 can be comprised of any number of suitable materials, such as, but not limited to, thermoplastics, thermosets, metals, woods, glasses, and combinations thereof. Preferably, thermoplastic materials are employed to construct the device 10 due to their relative ease of molding, low cost, light weight, low maintenance requirements, and durability. If a thermoplastic is chosen as the construction material, the primary components of the device 10 can conveniently be made by the process of injection molding, or other suitable molding techniques. Injection molding is generally defined as a method of forming a plastic to the desired shape by forcing heat-softened plastic into a relatively cool cavity under pressure. By utilizing injection molding, the primary components of the device 10 can conveniently be formed in essentially one step, as opposed to having to assemble individual components to one another.

The container 20 consists primarily of a base 60, a pair of opposed and spaced endwalls 70 and 80, and a pair of opposed and spaced sidewalls 90 and 100. Although the container 20 is shown as being substantially rectangular, it is envisioned that any number of suitable configurations may be employed, such as squares, rhomboids, parallelograms, circles, and the like. The interior of the container 20 defines a cavity. The upper peripheral surface 110 of the container 20 preferably defines a lip portion 120 that preferably mates with a portion of the lid 30. Optionally, the container 20 can be provided with a pair of spaced and opposed handles 21 and 22.

The lid 30 is a substantially planar member consisting of a base 125 and a downwardly depending wall 130 extending along the entire periphery of the base 125. The configuration of the lid 30 should preferably be identical to that of the container 20. Thus, a rectangular container will generally be associated with a rectangular lid, a square container will generally be associated with a square lid, and so forth. A portion of the downwardly depending wall 130 preferably includes a groove or recess 140 that mates with the lip portion 120 of the container 20 so as to establish a substantially airtight and watertight seal about the lid 30 and the container 20 so as to keep the cupcakes fresh and prevent them from drying out. It will be appreciated by the skilled artisan that the lid 30 is not essential to practice the present invention.

Figure 2:
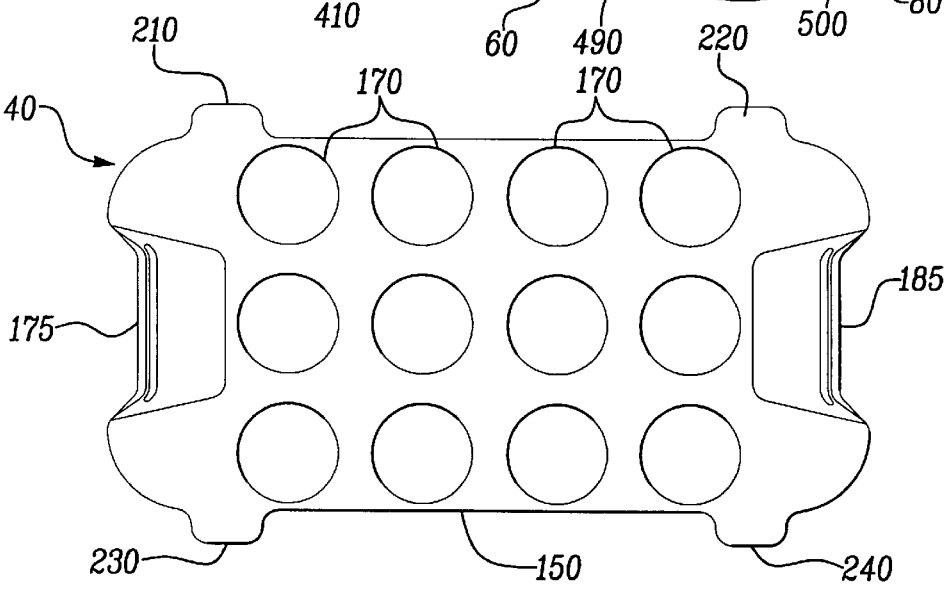
FIG. 2 is a top view of a removable insert in accordance with one embodiment of the present invention.
Figure 3:
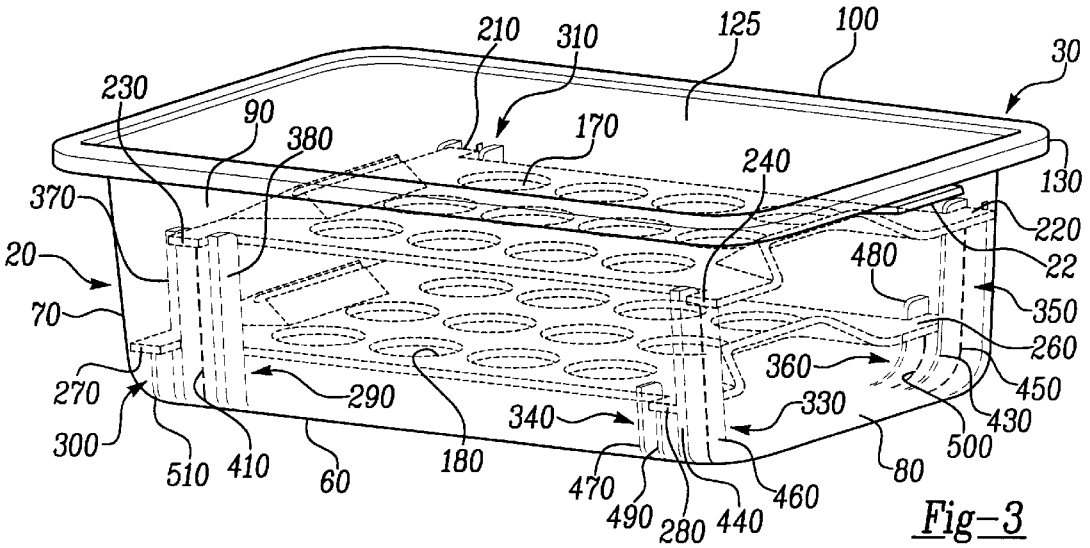
FIG. 3 is a perspective view of a device in accordance with one embodiment of the present invention.

The removable inserts 40 and 50 consist primarily of substantially planar members 150 and 160, respectively. The removable inserts 40 and 50 have a plurality of substantially circular apertures or openings 170 and 180, respectively, extending therethrough for receiving and retaining a plurality of baked goods such as, but not limited to, cupcakes, muffins, and the like. Referring specifically to FIG. 2, although only 12 openings are illustrated, the skilled artisan will appreciate that more or less than 12 openings may be provided. It will also be appreciated by the skilled artisan that only one cupcake is intended to be received and retained in each individual opening 170 and 180, respectively. It will be noted that the openings 170 and 180 are spaced a sufficient distance from any adjacent opening so as to prevent one cupcake from contacting another adjacent cupcake.

The removable inserts 40 and 50 are preferably provided with a pair of opposed and spaced handles 175, 185 and 190, 200, respectively, that enable a user to easily grasp and lift the inserts 40 and 50. The handles 175, 185 and 190, 200, respectively, are preferably raised and angled upwardly away from the top surface of the removable inserts 40 and 50, respectively. The exact configuration of the handles 175, 185 and 190, 200, respectively, is not critical provided that a user is able to easily grasp them. Additionally, the exact angle is not critical; however, an upward angle of between about 30 to about 60 degrees is preferred so as to enable a user to easily grasp them.

The inserts 40 and 50 are also provided with a plurality of horizontally oriented tabs 210, 220, 230, 240 and 250, 260, 270, 280, respectively, extending radially outward from the inserts 40 and 50, respectively. It will be appreciated by the skilled artisan that either less than or more than this number of tabs may be used to practice the present invention.

On an interior surface of the container 20 there are located a plurality of support members 290, 300, 310, 320, 330, 340, 350, and 360. It will be appreciated by the skilled artisan that either less than or more than this number of support members may be used to practice the present invention. The support members 290 and 310 comprise two vertically oriented elongated wall members 370, 380 and 390, 400, respectively, defining a groove, and a vertically oriented elongated shelf member, 410 and 420, respectively, located between the wall members 370, 380 and 390, 400, respectively. The height of the vertically oriented elongated shelf members, 410 and 420 respectively, is less than that of the vertically oriented elongated wall members 370, 380 and 390, 400, respectively. This configuration was chosen, in part, to reduce the amount of lateral movement of removable insert 40.

The support members 330 and 350 comprise a single vertically oriented elongated wall or guide member 430 and 440, respectively, and a vertically oriented elongated shelf member, 450 and 460, respectively, located in proximity to the guide members 430 and 440, respectively. The height of the vertically oriented elongated shelf members, 450 and 460, respectively, is less than that of the vertically oriented elongated guide members 430 and 440, respectively. Shelf members 410, 420, 450, and 460 are of equal height relative to the base 60 of the container 20. Thus, as a non-limiting illustration with respect to removable insert 40, tab 210 can be disposed on shelf member 420; tab 220 can be disposed on shelf member 450; tab 230 can be disposed on shelf member 410; and tab 240 can be disposed on shelf member 460. In practice, it is not critical as to which tab is disposed on which shelf member provided that the removable insert is properly supported by the shelf members. Thus, it will be appreciated by the skilled artisan that the removable insert 40 can be horizontally rotated about its central axis a sufficient amount (e.g., 180 degrees) in order to vary the positioning of the tabs.

The support members 340 and 360 comprise the vertically oriented elongated guide members 440, 430 and vertically oriented wall members 470, 480, respectively, defining a groove, and a vertically oriented elongated shelf member, 490 and 500, respectively, located between the guide members 440, 430 and wall members 470, 480, respectively. The height of the vertically oriented elongated shelf members, 490 and 500 respectively, is less than that of the vertically oriented elongated wall members 470 and 480, respectively. As referenced above, this configuration was chosen, in part, to reduce the amount of lateral movement of removable insert 50.

The support members 300 and 320 comprise the vertically oriented elongated wall members 370 and 390, respectively, and a vertically oriented elongated shelf member, 510 and 520, respectively, located in proximity to the wall members 370 and 380, respectively. The height of the vertically oriented elongated shelf members, 510 and 520 respectively, is less than that of the vertically oriented elongated wall members 370 and 380, respectively. Shelf members 490, 500, 510, and 520 are of equal height relative to the base 60 of the container 20. Thus, as a non-limiting illustration with respect to removable insert 50, tab 250 can be disposed on shelf member 520; tab 260 can be disposed on shelf member 500; tab 270 can be disposed on shelf member 510; and tab 280 can be disposed on shelf member 490. In practice, it is not critical as to which tab is disposed on which shelf member provided that the removable insert is properly supported by the shelf members. Thus, it will be appreciated by the skilled artisan that the removable insert 50 can be horizontally rotated about its central axis a sufficient amount (e.g., 180 degrees) in order to vary the positioning of the tabs.

As previously described, it is intended that an individual cupcake be received and retained in each individual opening 170 and 180, respectively. With specific reference to FIG. 5, the base of the cupcake extends freely through openings 170 and 180, respectively, whereas the top of the cupcake is prevented from extending through the openings 170 and 180, respectively, due to the top's geometric configuration. Additionally, it will be appreciated by the skilled artisan that not every opening 170 and 180, respectively, need have its own individual cupcake. The present invention can be practiced with only one cupcake or a plurality of cupcakes, as well as with only one removable insert or a plurality of removable inserts.

Figure 4:
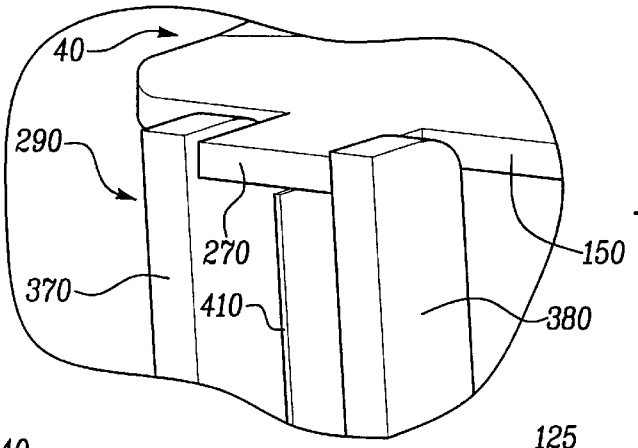
FIG. 4 is an enlarged partial perspective view of a tab of a removable insert cooperating with a groove and shelf assembly in accordance with one embodiment of the present invention.
Figure 5:
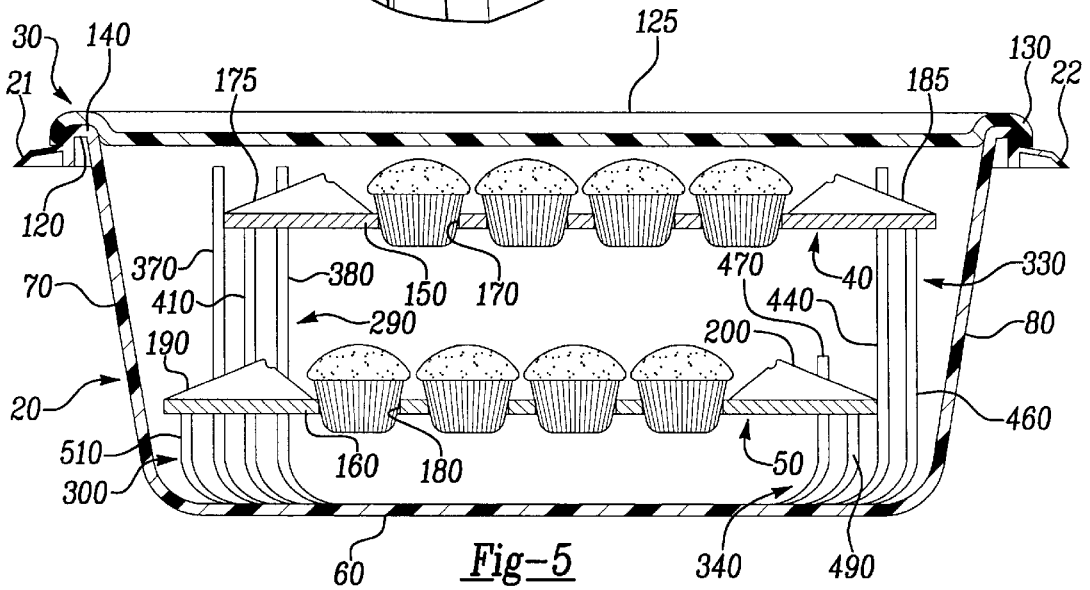
FIG. 5 is a cross-sectional view of a device in accordance with one embodiment of the present invention.

Once the desired number of cupcakes have been loaded into the removable inserts 40 and 50, the removable inserts 40 and 50 can then be loaded into the container 20. The order in which the removable inserts are loaded into the container 20 is not critical; however, for reference purposes, removable insert 50 is loaded into the container 20 first, and may therefore be referred to as the lower or bottom removable insert. Accordingly, once removable insert 40 is loaded into the container 20, it may be referred to as the upper or top removable insert. It will be appreciated by the skilled artisan that removable insert 40 and removable insert 50 are interchangeable. The loading of the removable inserts 40 and 50 is accomplished by aligning the respective tabs of the removable inserts with the respective grooves of the respective support means and then lowering the removable insert until it contacts a respective shelf member. Referring specifically to FIG. 4, the alignment of tab 230 within the groove defined by wall members 370 and 380, as well as the disposition of tab 230 upon shelf member 410 is illustrated. Once these alignments and dispositions have been accomplished, successive removable inserts can then be loaded into and onto other groove and shelf assemblies. Thus, in this manner, the removable inserts are characterized as being nestable within the container 20. Referring specifically to FIG. 5, it should be noted that the removable inserts are slightly offset with respect to one another due to the respective grooves being spaced apart from one another. In accordance with one embodiment of the present invention, a first removable insert is intended to rest on a shelf member located in proximity to the base of the container 20, and a second removable insert is intended to rest on a shelf member located in proximity to the lip portion of the container 20. It should be noted that the cupcakes of the lower removable insert 50 are spaced a sufficient distance from the cupcakes of the upper removable insert 40 so as to prevent the cupcakes of one removable insert from contacting the cupcakes of an adjacent removable insert. Additionally, it should be noted that the cupcakes of the lower removable insert 50 are spaced a sufficient distance from the base of the container 20 so as to avoid unwanted contact with the base of the container 20.

Once all of the removable inserts are loaded, the lid 30 may then be placed on the container so as to cover the cupcakes in order to keep them fresh and protect them from airborne dust, particles, germs, and other unwanted debris. The lid 30 should not contact the cupcakes of the upper removable insert 40. The device 10, with its payload of cupcakes, may be stored or transported to a remote location.

Figure 6:
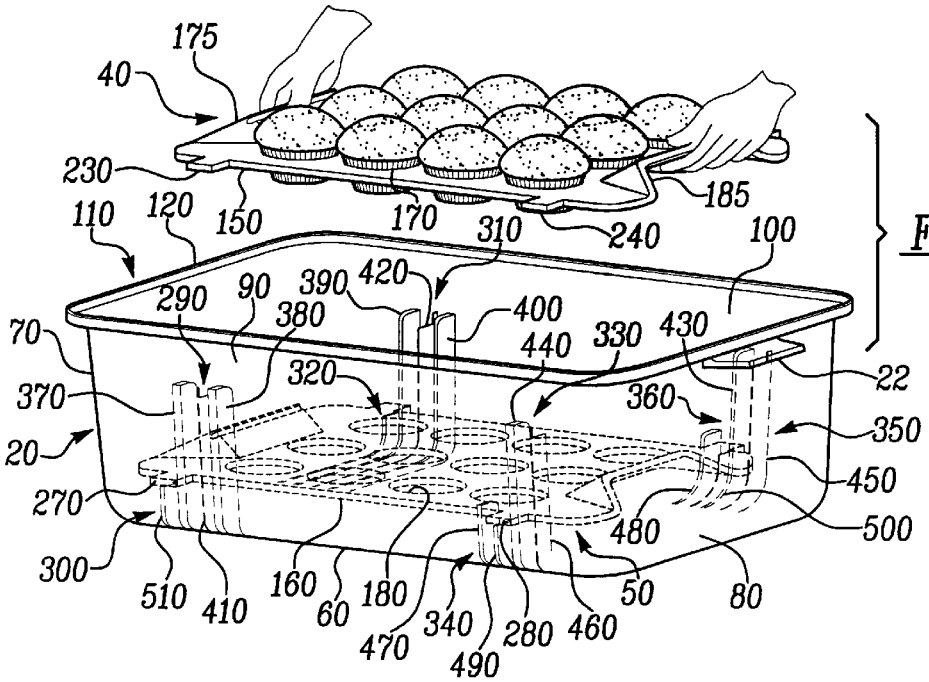
FIG. 6 is a perspective view illustrating the removal of a loaded removable insert from the container in accordance with one embodiment of the present invention.
Figure 7:
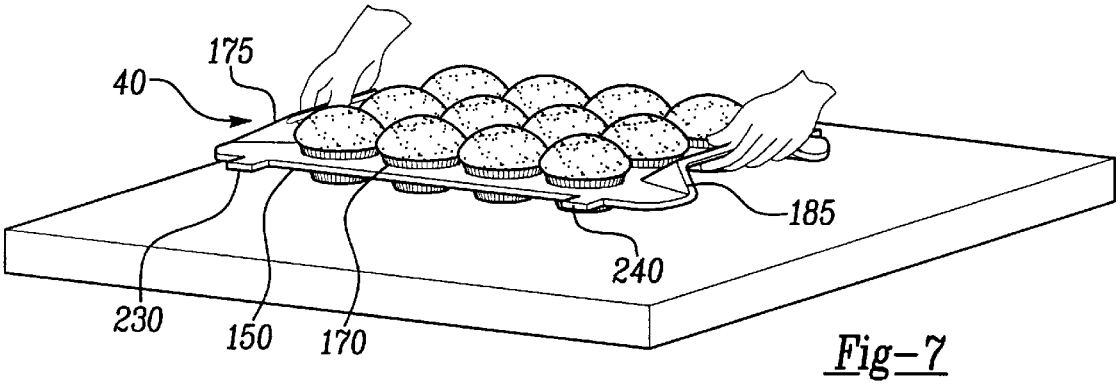
FIG. 7 is a perspective view illustrating the loaded removable insert from the container being initially placed onto a flat surface in accordance with one embodiment of the present invention.
Figure 8:
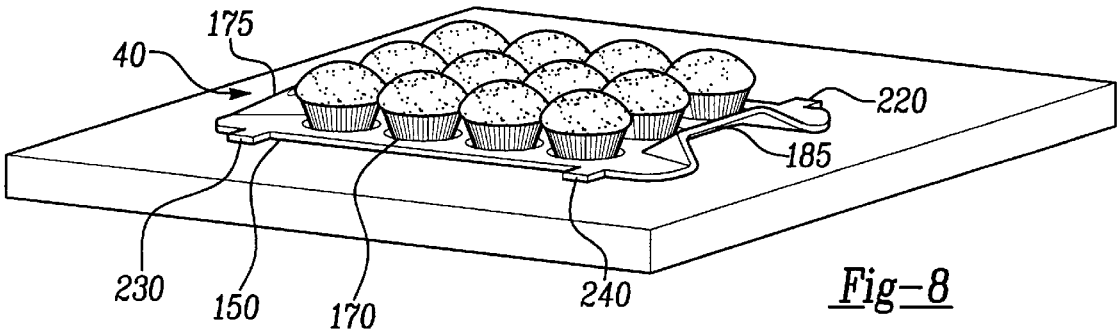
FIG. 8 is a perspective view illustrating the loaded removable insert from the container being completely and fully placed onto a flat surface whereupon the cupcakes are dislodged from their respective openings in accordance with one embodiment of the present invention.

With reference to FIGS. 6–8, the removal of the cupcakes from the removable inserts will be described in detail. Initially, the lid 30 should be removed from the container 20 so as to provide a user access to the interior of the container 20. Referring specifically to FIG. 6, the user then simply reaches into the container 20 and grasps the first or highest loaded removable insert (in this instance removable insert 40) by the handles 175 and 185 and lifts the loaded removable insert 40 upwardly out of the container 20. If there are additional loaded removable inserts, they may be removed from the container 20 in an identical manner. Once the loaded removable insert 40 has been removed, it should be placed onto a flat, preferably stable, surface. Referring specifically to FIG. 7, when the loaded removable insert 40 is initially lowered onto a flat surface, it is the base portion, specifically the bottom surface, of the cupcakes that first contact the flat surface thus imparting an upward force on the cupcakes. As the loaded removable insert 40 is still further lowered onto the flat surface, the cupcakes are in effect urged further upwardly out of their respective openings 170. Referring specifically to FIG. 8, once the loaded removable insert 40 contacts the flat surface, the cupcakes are completely dislodged from their respective openings 170, and are ready for immediate serving and consumption.

Additionally, the device of the present invention can be constructed on any scale desired. In accordance with a preferred embodiment of the present invention, the removable insert has length of about 18 inches, a width of about 10 inches, and a thickness of about ⅛ inch to about ¼ inch. The openings of the removable insert have a diameter of about 2.5 inches. The tabs of the removable insert extend out from the body of the removable insert about 1 inch and have a width of about 1 inch. Accordingly, the container should have suitable dimensions which are capable of receiving the removable insert. Likewise, the lid should have suitable dimensions which are capable of covering the container.

The foregoing description is considered illustrative only of the principles of the invention. Furthermore, because numerous modifications and changes will readily occur to those skilled in the art, it is not desired to limit the invention to the exact construction and process shown as described above. Accordingly, all suitable modifications and equivalents that may be resorted to that fall within the scope of the invention as defined by the claims that follow.

What is claimed is:

1. A food storage and transportation device, comprising:

a container;

at least one support means, the at least one support means being disposed on and projecting from an inner surface of the container and including a vertical support member; and at least one removable insert, the at least one removable insert having a plurality of horizontally oriented tabs extending radially outward, the at least one removable insert having a plurality of openings and being disposed on the at least one support means and said tabs being supported by said vertical support member.

2. The device of claim 1, wherein there are two removable inserts.

3. The device of claim 1, wherein there are two support means.

4. The device of claim 1, wherein the container has a pair of handles.

5. The device of claim 1, wherein the support means comprises a support member, the support member comprising a vertically oriented elongated groove and a vertically oriented elongated shelf member, the shelf member being located in the groove.

6. The device of claim 1, wherein the support means comprises a support member, the support member comprising a vertically oriented elongated guide member and a vertically oriented elongated shelf member, the shelf member being located in proximity to the guide member.

7. The device of claim 1, wherein the removable insert is a substantially planar member.

8. The device of claim 1, wherein the removable insert has a pair of handles.

9. The device of claim 2, wherein the two removable insert are nestable in the container, the two removable inserts being spaced from one another.

10. The device of claim 1, wherein a baked good is received in the opening of the removable insert.

11. The device of claim 10 wherein the baked good is a cupcake, the cupcake having a base portion and a top portion.

12. The device of claim 10, wherein the base portion of the cupcake extends through the opening of the removable insert and the top portion of the cupcake is retained above a top surface of the removable insert.

13. The device of claim 1, further comprising a lid, the lid being disposed on the container.

14. The device of claim 13, wherein the device is constructed of materials selected from the group consisting of thermoplastics, thermosets, metals, woods, glasses, and combinations thereof.

15. A food storage and transportation device, comprising:

a container having an open end, the container having an inner surface and an outer surface;

at least one support means, the support means being disposed on and projecting from an inner surface of the container, the support means comprising a plurality of support members defining a groove and a shelf member;

at least one removable insert, the removable insert having a plurality of openings, the removable insert having a plurality of horizontally oriented tabs extending radially outward, the tabs being received in the grooves of the support members and disposed on the shelf members of the support members; and a lid.

16. The device of claim 15, wherein there are two removable inserts.

17. The device of claim 15, wherein there are two support means.

18. The device of claim 16, wherein the two removable inserts are nestable in the container, the two removable inserts being spaced from one another.

19. The device of claim 15, wherein a baked good is received in the opening of the removable insert.

20. The device of claim 19, wherein the baked good is a cupcake, the cupcake having a base portion and a top portion.

21. The device of claim 20, wherein the base portion of the cupcake extends through the opening of the removable insert and the top portion of the cupcake is retained above a top surface of the removable insert.

22. The device of claim 15, wherein the device is constructed of materials selected from the group consisting of thermoplastics, thermosets, metals, woods, glasses, and combinations thereof.

* * * * *

UNITED STATES PATENT AND TRADEMARK OFFICE

CERTIFICATE OF CORRECTION

PATENT NO. : 5,912,033
DATED : June 15, 1999
INVENTOR(S) : Kathy Ferguson

It is certified that error appears in the above-identified patent and that said Letters Patent is hereby corrected as shown below:

Title page,
Item [56], References Cited, U.S. PATENT DOCUMENTS, insert the following:

-- D 346,528 5/1994 Crawford et al.
D 356,716 3/1995 Dornbush et al.
D 365,502 12/1995 Runge
2,057,951 10/1936 Ingram et al.
3,633,786 1/1972 Leedy
3,756,681 9/1973 Croston
3,944,109 3/1976 Holz
4,348,421 9/1982 Sakakibara et al.
5,421,459 6/1995 Mazzotti
5,597,073 1/1997 Kocis
5,632,924 5/1997 Gics et al. --.

Insert the following:
-- OTHER PUBLICATIONS
Advertisement for Ice Cream Cupcake Baking Pan On Side Panel of Joy Cone Box, Date Unknown --.

Signed and Sealed this

Thirtieth Day of May, 2006

JON W. DUDAS
*Director of the United States Patent and Trademark Office*